US011660609B2

(12) United States Patent
Kellnberger

(10) Patent No.: US 11,660,609 B2
(45) Date of Patent: May 30, 2023

(54) OUTLET DEVICE OF A SOLID-BOWL SCREW CENTRIFUGE WITH A DIVERTING CHANNEL

(71) Applicant: FLOTTWEG SE, Vilsbiburg (DE)

(72) Inventor: Alfons Kellnberger, Massing (DE)

(73) Assignee: FLOTTWEG SE, Vilsbiburg (DE)

( * ) Notice: Subject to any disclaimer, the term of this patent is extended or adjusted under 35 U.S.C. 154(b) by 333 days.

(21) Appl. No.: 16/771,202

(22) PCT Filed: Dec. 20, 2018

(86) PCT No.: PCT/EP2018/086034
§ 371 (c)(1),
(2) Date: Jun. 9, 2020

(87) PCT Pub. No.: WO2019/122045
PCT Pub. Date: Jun. 27, 2019

(65) Prior Publication Data

US 2020/0368762 A1 Nov. 26, 2020

(30) Foreign Application Priority Data

Dec. 21, 2017 (DE) ..... 102017130904.7

(51) Int. Cl.
*B04B 1/20* (2006.01)
*B04B 11/02* (2006.01)

(52) U.S. Cl.
CPC ..... *B04B 1/20* (2013.01); *B04B 11/02* (2013.01); *B04B 2001/2041* (2013.01); *B04B 2001/2075* (2013.01); *B04B 2001/2083* (2013.01)

(58) Field of Classification Search
CPC ... B04B 1/20; B04B 11/02; B04B 2001/2041; B04B 2001/2075; B04B 2001/2083
(Continued)

(56) References Cited

U.S. PATENT DOCUMENTS 5,147,277 A * 9/1992 Shapiro ..... B04B 1/20 210/374
9,333,514 B2 5/2016 Terholsen et al.
2014/0051565 A1* 2/2014 Terholsen ..... B04B 1/20 494/53

FOREIGN PATENT DOCUMENTS

DE 202011110235 U1 2/2013 ..... B04B 1/12
WO WO2012013624 A2 2/2012 ..... B04B 1/20
(Continued)

OTHER PUBLICATIONS

An Office Action (in Turkish) and an English translation thereof, dated Dec. 28, 2021, issued by the Turkish Patent and Trademark Office for Applicant's related Turkish Patent Application No. 2020/09529, filed Dec. 20, 2018.
(Continued)

*Primary Examiner* — Shuyi S. Liu
(74) *Attorney, Agent, or Firm* — Bodner & O'Rourke, LLP; Gerald T. Bodner; Christian P. Bodner

(57) ABSTRACT

The invention relates to an outlet device (10) of a solid-bowl screw centrifuge for separating a multi-phase material, which outlet device is arranged on an end wall (12) of a centrifuge drum, which rotates about a longitudinal axis, at an outlet opening (20) formed in the end wall, which outlet device comprises a diverting channel (22) for diverting a liquid phase of the material which passes through the outlet opening (20), wherein the diversion relative to the longitudinal axis amounts to an angle (32) between 50° and 90° with respect to the circumferential direction, and which outlet device has an aligned rectilinear weir edge (30) for limiting the emergence of the liquid phase, wherein the angle of the alignment of the weir edge (30) relative to the end wall (12) as viewed from the outlet opening (20) amounts to between 0° relative to the end wall and minus 6° toward the end wall.

12 Claims, 10 Drawing Sheets

(58) Field of Classification Search
USPC ..... 494/53, 56
See application file for complete search history.

(56) References Cited

FOREIGN PATENT DOCUMENTS

| | | | | |
|---|---|---|---|---|
| WO | WO-2012089492 A1 * | 7/2012 | ..... | B04B 1/20 |
| WO | WO2012089492 A1 | 7/2012 | ..... | B04B 1/20 |

OTHER PUBLICATIONS

The Notification Concerning Transmittal of International Preliminary Report on Patentability (Chapter I of the Patent Cooperation Treaty), in English, dated Jul. 2, 2020, which was issued by the International Bureau of WIPO in Applicant's corresponding international PCT application having Serial No. PCT/EP2018/086034, filed on Dec. 20, 2018.
The English translation of the International Preliminary Report on Patentability (Chapter I of the Patent Cooperation Treaty), dated Jun. 23, 2020, which was issued by the International Bureau of WIPO in Applicant's corresponding international PCT application having Serial No. PCT/EP2018/086034, filed on Dec. 20, 2018.
The Written Opinion of the International Searching Authority, in English, dated Mar. 8, 2019, which was issued by the International Bureau of WIPO in Applicant's corresponding international PCT application having Serial No. PCT/EP2018/086034, filed on Dec. 20, 2018.
The International Search Report, in English, dated Mar. 8, 2019, which was issued by the International Bureau of WIPO in Applicant's corresponding international PCT application having Serial No. PCT/EP2018/086034, filed on Dec. 20, 2018.

* cited by examiner

OUTLET DEVICE OF A SOLID-BOWL SCREW CENTRIFUGE WITH A DIVERTING CHANNEL

BACKGROUND OF THE INVENTION

The invention relates to an outlet device of a solid-bowl screw centrifuge for separating a multi-phase material, which outlet device is arranged on an end wall of a centrifuge drum, which rotates about a longitudinal axis, at an outlet opening formed in the end wall, which outlet device comprises a diverting channel for diverting a liquid phase of the material which passes through the outlet opening and which has an aligned rectilinear weir edge for limiting the emergence of the liquid phase.

In general, solid-bowl screw centrifuges have a rotatable centrifuge drum, which have a drum shell, which is closed to the greatest possible extent, with a mostly horizontally extending rotational axis or longitudinal axis. The centrifuge drum is rotated by means of a drive at high rotational speed. Into the centrifuge drum, a multi-phase material to be centrifuged is introduced by means of an inlet tube that is centrally arranged in most cases. By the rotation of the centrifuge drum, the multi-phase material is then subjected to a high centrifugal force, whereby it attaches inside to the drum shell as a pool. In the material centrifuged in such a way, a phase separation occurs, wherein a comparatively light-weight material in the pool migrates radially inward as a light liquid phase, and comparatively heavy material migrates radially outward as a heavy solid phase. Radially inside, the light liquid phase can be discharged by means of an outlet device, whereas the heavy solid phase is withdrawn from the centrifuge drum by means of a screw.

From DE 20 2011 110 235 U1, a liquid phase outlet port component arranged at a drum of a decanter centrifuge is known, for example, which has a rectilinear channel. This channel forms a track which is arranged spaced from a longitudinal axis of the decanter centrifuge by a track radius. The channel is arranged at an acute angle relative to an end-sided base plate of the drum so as to divert a material reaching an outlet opening present in the base plate sideways of the drum. This allows the material exiting the outlet opening substantially in an axial direction to be diverted laterally outward along the track element for the purpose of energy recovery, before it is dropped at the end of the straight channel or the track at the level of the track radius from the liquid phase outlet port component.

Basic Task

The invention is based on the task of further developing generic outlet devices of a solid-bowl screw centrifuge in order to achieve an effective energy recovery.

Solution According to the Invention

The task of the invention is solved by an outlet device of a solid-bowl screw centrifuge for separating a multi-phase material, which outlet device is arranged on an end wall of a centrifuge drum, which rotates about a longitudinal axis, at an outlet opening formed in the end wall, which outlet device comprises a diverting channel for diverting a liquid phase of the material which passes through the outlet opening, wherein the diversion relative to the longitudinal axis amounts to an angle between 50° and 90° with respect to the circumferential direction, and which outlet device has an aligned rectilinear weir edge for limiting the emergence of the liquid phase, wherein the alignment of the weir edge relative to the end wall as viewed from the outlet opening amounts to between 0° relative to the end wall and minus 6° toward the end wall.

According to the invention, the outlet device comprises a diverting channel quite specially formed with respect to the angle of diversion with a thereto quite specially adapted configuration and alignment of the weir edge. Verifications according to the invention have shown that such a configuration altogether results in a particularly strong rebounding effect of the exiting liquid phase at the outlet device. According to the invention, the energy saving for driving the centrifuge drum achieved with the outlet device may again be improved.

The task of the invention is also solved by an associated method for energy recovery at a solid-bowl screw centrifuge.

The outlet device according to the invention is advantageously provided with a diverting channel formed as a channel that is open radially inward. This allows the diverting channel to not become plugged and to be better cleaned during maintenance. Alternatively, the diverting channel may be designed as a tube enclosing the exiting liquid phase.

The diverting channel is further designed to be narrowing, in particular continuously narrowing, preferably in the flow direction of the liquid phase. Such a narrowing allows a nozzle effect to be achieved for the exiting liquid phase. Alternatively, the diverting channel is designed to have substantially equally spaced sidewalls all throughout the entire flow track of the liquid phase.

In an optional embodiment of the invention, it is possible that the alignment of the weir edge relative to the end wall as viewed from the outlet opening amounts to less than 0° relative to the end wall.

In other words, the weir edge extends at an angle of between 0° relative to the end wall and minus 6° toward the end wall.

It is possible for the angle to be less than 0° to minus 6°.

Furthermore, at least one flow guiding element is preferably arranged in the diverting channel. Such a flow guiding element may be designed preferably in the form of a rib or web extending in the flow direction.

The flow guiding element leads to a division of the diverting channel into a plurality of narrow channels in which mostly equally high liquid levels will then develop. This will prevent the exiting liquid phase during the diversion from accumulating at the outside in the diversion curve, which would reduce the energy saving effect as verifications according to the invention have shown.

In the flow direction of the liquid phase, the outlet device according to the invention further advantageously has a flow guiding surface behind the weir edge, over which surface exiting liquid phase flows, and which is designed at least in sections as viewed in the axial direction to have no side wall on one side. Particularly advantageously, the flow guiding surface according to the invention has no side wall especially in the area of the axial projection of the weir edge. The side wall lacking there forms a kind of lateral air inlet area for ambient air to the upper side of the flow guiding surface.

The flow guiding surface preferably has a main flow direction which is oriented to be pivoted above the weir edge toward the end wall as compared to a main flow direction of the liquid phase. Such an orientation of the flow guiding surface achieves that exiting liquid phase will not flow off laterally, thus in the axial direction from the flow guiding surface, even if the side wall is lacking.

The flow guiding surface is in this case designed to be preferably spaced from the end wall on the side of the drum. Alternatively, the flow guiding surface is designed to be adjacent outside at the end wall in the axial direction. Both variants have particular advantages with respect to the attachment and adjustability of the outlet device according to the invention.

The effect of hitherto known outlet devices normally is based on the fact that the liquid phase having passed through the outlet opening is diverted in a channel with side walls and is drained in the such diverted state. Here, the flow velocity of the liquid phase, which will be guided toward the end wall circumference and withdrawn, depends to a large extent on the liquid amount flowing in the channel per unit of time. If the liquid amount is large, a high liquid level will develop in the channel. If the liquid amount is low, a small liquid level will develop. According to the height of the liquid level, however, the amount of recovered energy decreases as verifications according to the invention have shown. The solution according to the invention, however, enables the exiting liquid phase to laterally distribute on a flow guiding surface, whereby the liquid level can be kept comparatively low.

In the outlet device, the diverting channel is further advantageously integrated at least in part into a drum cover of the centrifuge drum. Thus, a particularly compact, space-saving solution can be created which is particularly advantageous in comparatively small machines.

Furthermore, the diverting channel of the outlet device according to the invention may be advantageously mounted to the end wall of the centrifuge drum so as to be adjustable. Adjusting allows the liquid level of the light phase in the centrifuge drum, the so-called pool depth, to be adjusted. The liquid level is in this case determined by the shortest radial distance of the weir edge of the outlet device from the longitudinal axis of the centrifuge drum. The outlet device according to the invention accordingly is adjustable in a particularly preferred manner in the distance from the longitudinal axis and/or in the angle of inclination to the circumferential direction.

The invention is finally also directed to a use of such an outlet device according to the invention on a solid-bowl screw centrifuge for separating a multi-phase material by means of a centrifuge drum.

BRIEF DESCRIPTION OF THE DRAWINGS

Hereinafter, exemplary embodiments of the outlet device according to the invention on a solid-bowl screw centrifuge will be explained in more detail with reference to the attached schematic drawings. Shown is in.

DETAILED DESCRIPTION OF THE EXEMPLARY EMBODIMENTS

Figure 1:
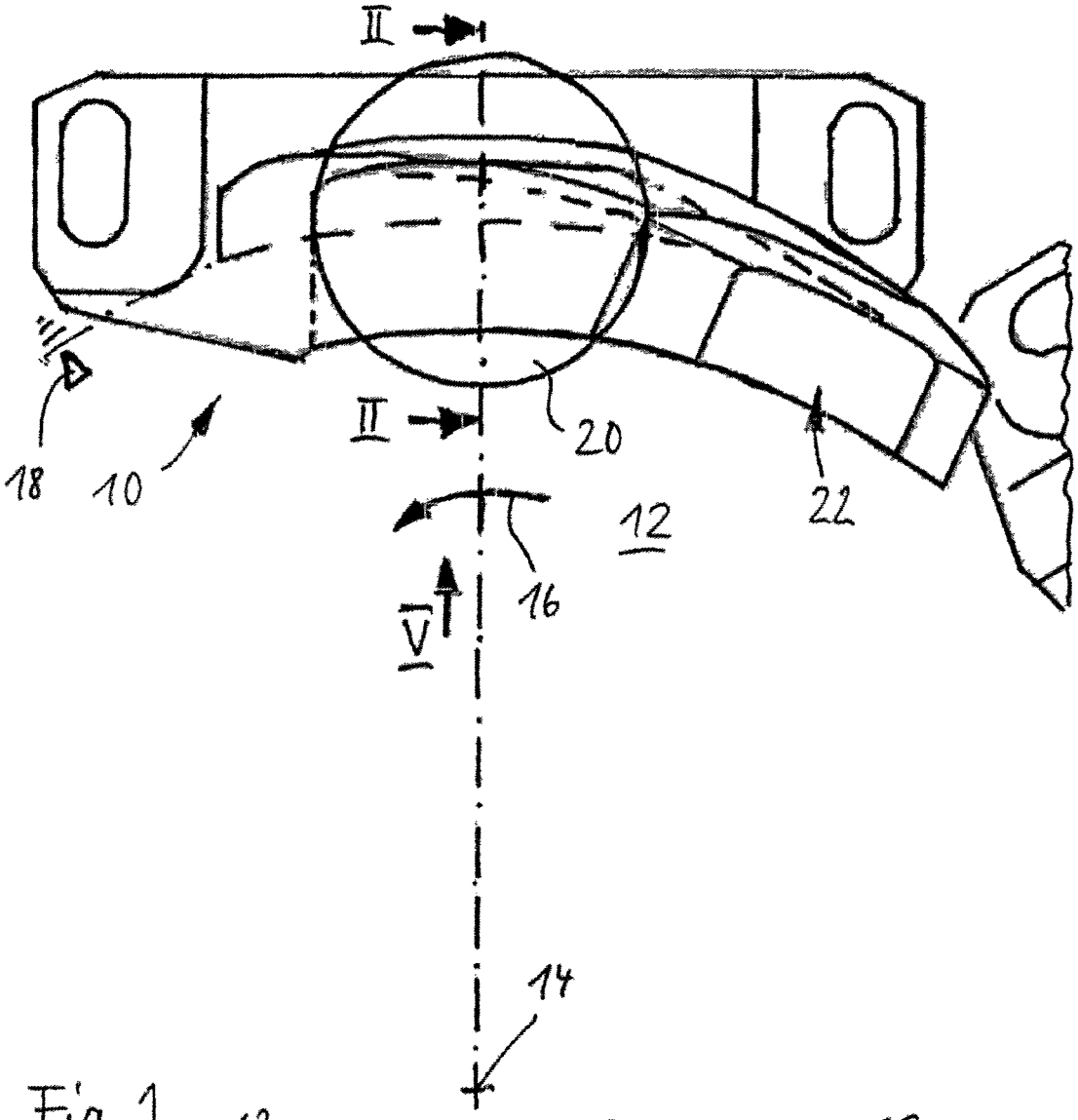
FIG. 1 a frontal view of an end wall of a centrifuge drum of a solid-bowl screw centrifuge, with an outlet device according to the invention being arranged on the end wall, FIG. 2 a section II-II of the end wall according to FIG. 1, FIG. 3 a first variant of the embodiment according to FIG. 2, FIG. 4 a second variant of the embodiment according to FIG. 2, FIG. 5, FIG. 5*a* the view V of the outlet device according to FIG. 1, FIG. 6 a first variant of the embodiment according to FIG. 5, FIG. 7 a second variant of the embodiment according to FIG. 5, FIG. 8 a third variant of the embodiment according to FIG. 5, FIG. 9 a fourth variant of the embodiment according to FIG. 5, FIG. 10 a fifth variant of the embodiment according to FIG. 5, FIG. 11 a sixth variant of the embodiment according to FIG. 5, and FIG. 12 a longitudinal section of the end wall according to FIG. 1 with the outlet device according to FIG. 11.

In FIGS. 1 to 12, diverse outlet devices 10 are depicted, which are each arranged to be radially adjustable on an end wall 12 of a not further depicted centrifuge drum of a solid-bowl screw centrifuge of the conventional type of construction. The centrifuge drum may in this case rotate at high speed about a longitudinal axis 14 in a rotational direction 16. Inside the centrifuge drum, a material to be cleared is present, whose light liquid phase accumulates radially inside and occupies a pool radius or a liquid level 18. The liquid level 18 is determined by an outlet opening 20 positioned in the end wall 12 and through which the material of the light phase may flow out of the centrifuge drum to the outside.

Figure 2:
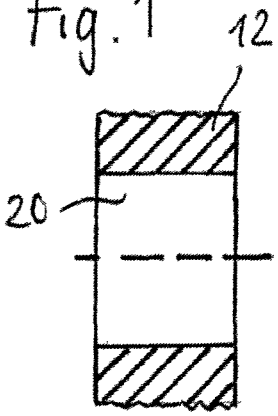
Figure 3:
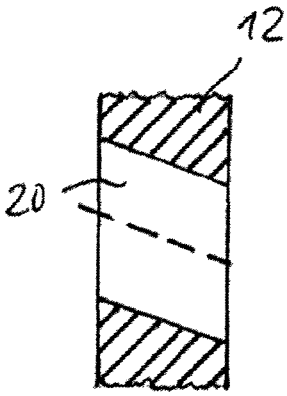
Figure 4:
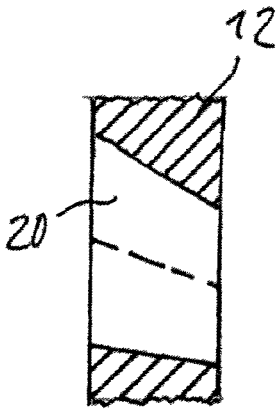
Figure 5:
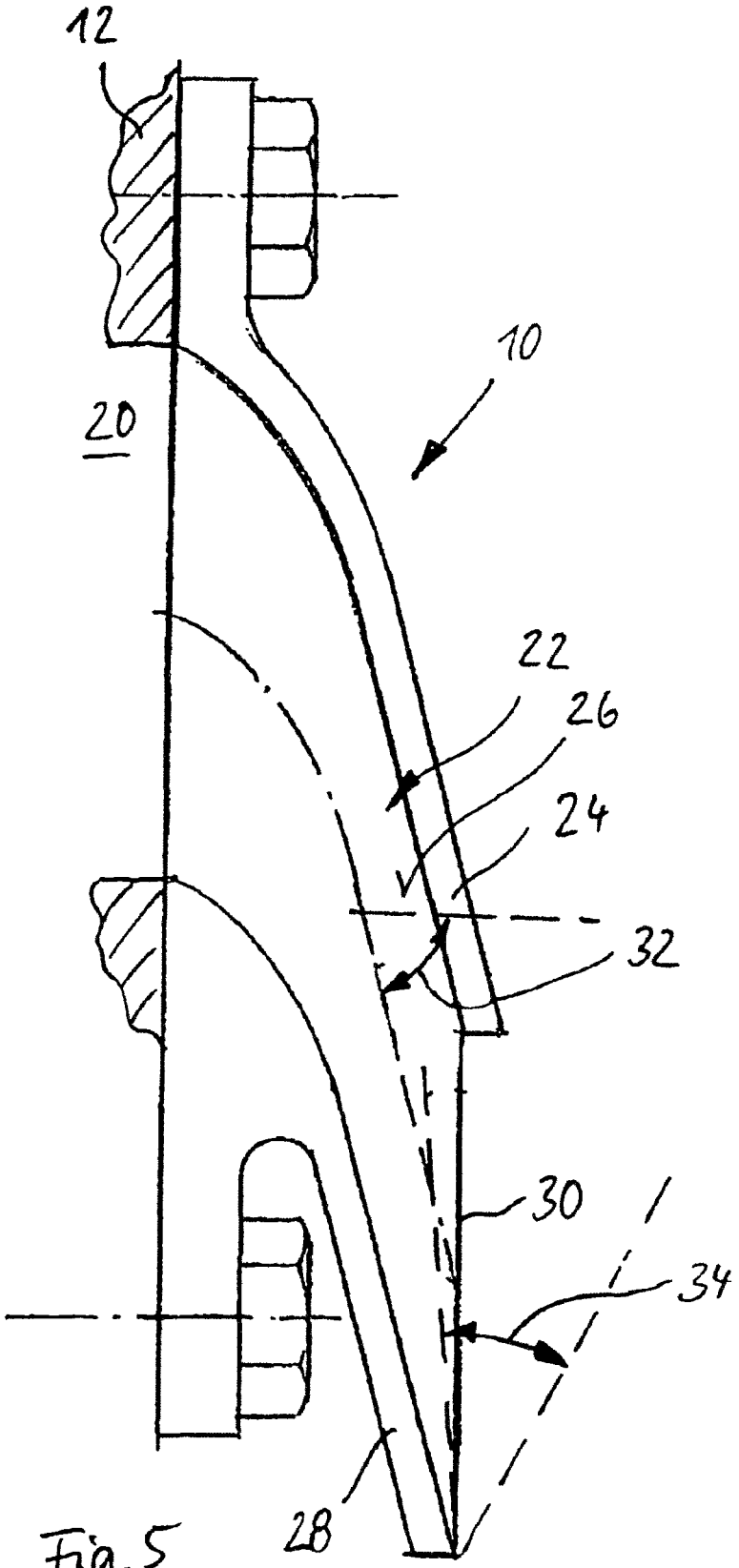
Figure 5A:
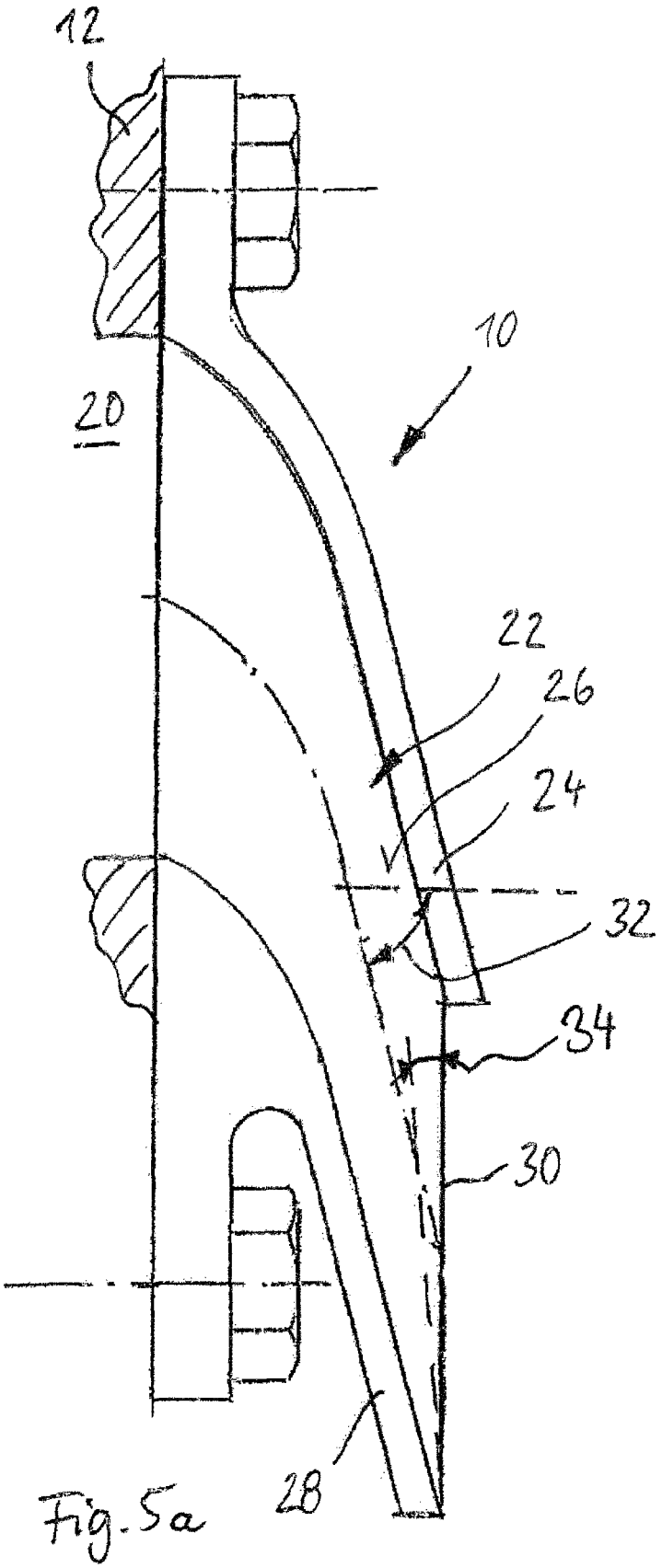

In FIGS. 2 to 4, three variants of the outlet opening 20 are illustrated, with the variant according to FIG. 2 being designed as a cylinder passage opening oriented in the longitudinal direction, the variant according to FIG. 3 being designed as an obliquely oriented cylinder passage opening, and the variant according to FIG. 4 being designed as a passage opening tapering in the form of a truncated cone.

In the flow through direction behind the outlet opening 20 or outside in front of the outlet opening 20, the outlet device 10 is positioned with an associated diverting channel 22. The exiting light phase flows through the outlet opening 20 into this diverting channel 22 and is diverted on this occasion from the direction of the longitudinal axis 14 transversely to the longitudinal axis 14 into the associated circumferential direction of the centrifuge drum. In this manner, the flow pulse of the liquid phase flowing out may be utilized to impart a pulse to the centrifuge drum acting in the rotational direction. This allows driving energy for driving the centrifuge drum to be recovered.

The diverting channel 22 is designed as a radially inward open channel with a first side wall 24, a bottom surface 26 and a second side wall 28. In this case, the side walls 24 and 28 are oriented such that this channel continuously tapers in the flow direction of the exiting light phase. At the end of the gutter-like channel, an associated weir edge 30 of the outlet device 10 is positioned. This weir edge 30 forms the part of the bottom surface 26 projecting furthest radially inward, and this defines the liquid level 18.

The diversion of the outflowing material of the liquid phase by means of the diverting channel 22 relative to the outside of the end wall 12 has an angle 32 of between 50° and 90° from the direction of the longitudinal axis 14 toward the circumferential direction or rotational direction 16 of the centrifuge drum.

The weir edge 30 at the end of the diverting channel 22 is in this case designed to be rectilinear and extends at an angle 34 of between minus 6° toward the end wall 12 and 0° away from the end wall 12. In other words, the weir edge 30 extends at an angle 34 of between 0° relative to the end wall 12 and minus 6° toward the end wall 12.

Figure 6:
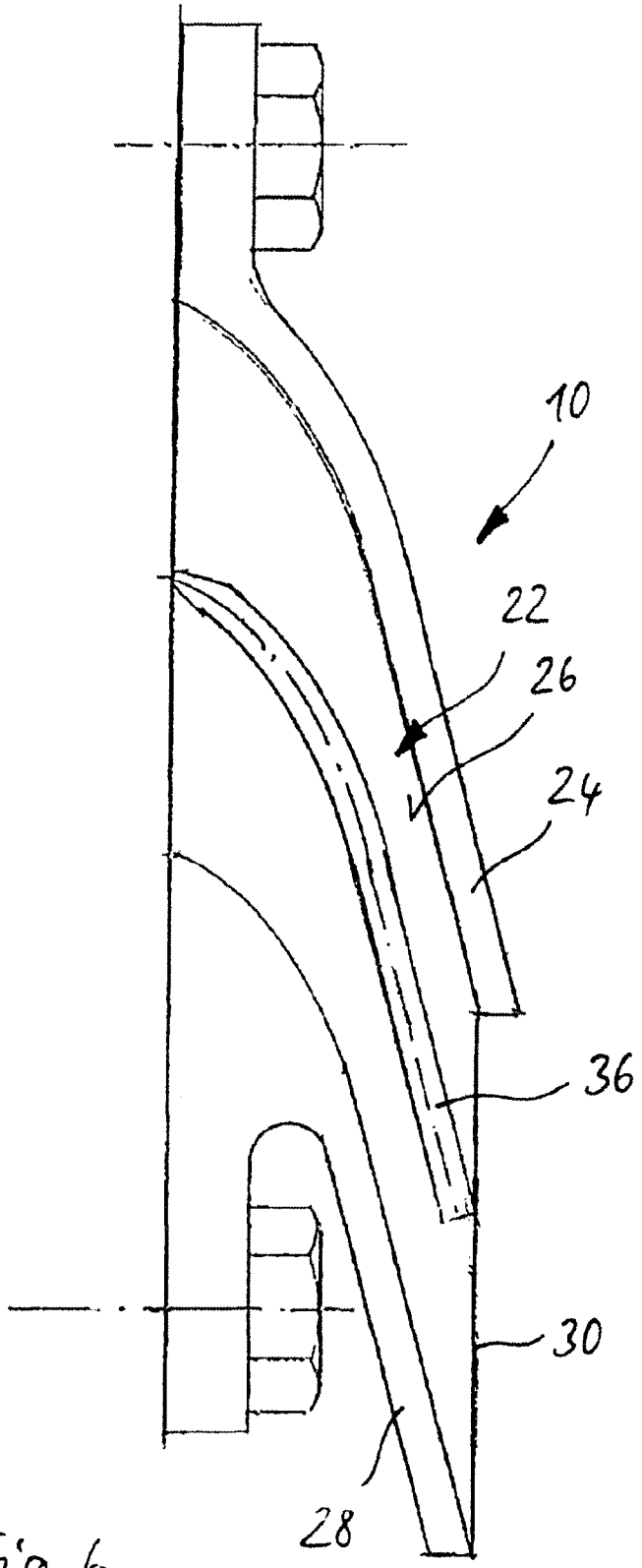

A rib-shaped flow guiding element 36 is positioned in the diverting channel 22 according to FIG. 6 in the center of the bottom surface 26 thereof. This flow guiding element 36 projects radially inward from the bottom surface 26 as a narrow wall. The flow guiding element 36 extends from the beginning to the end of the diverting channel 22.

Figure 7:
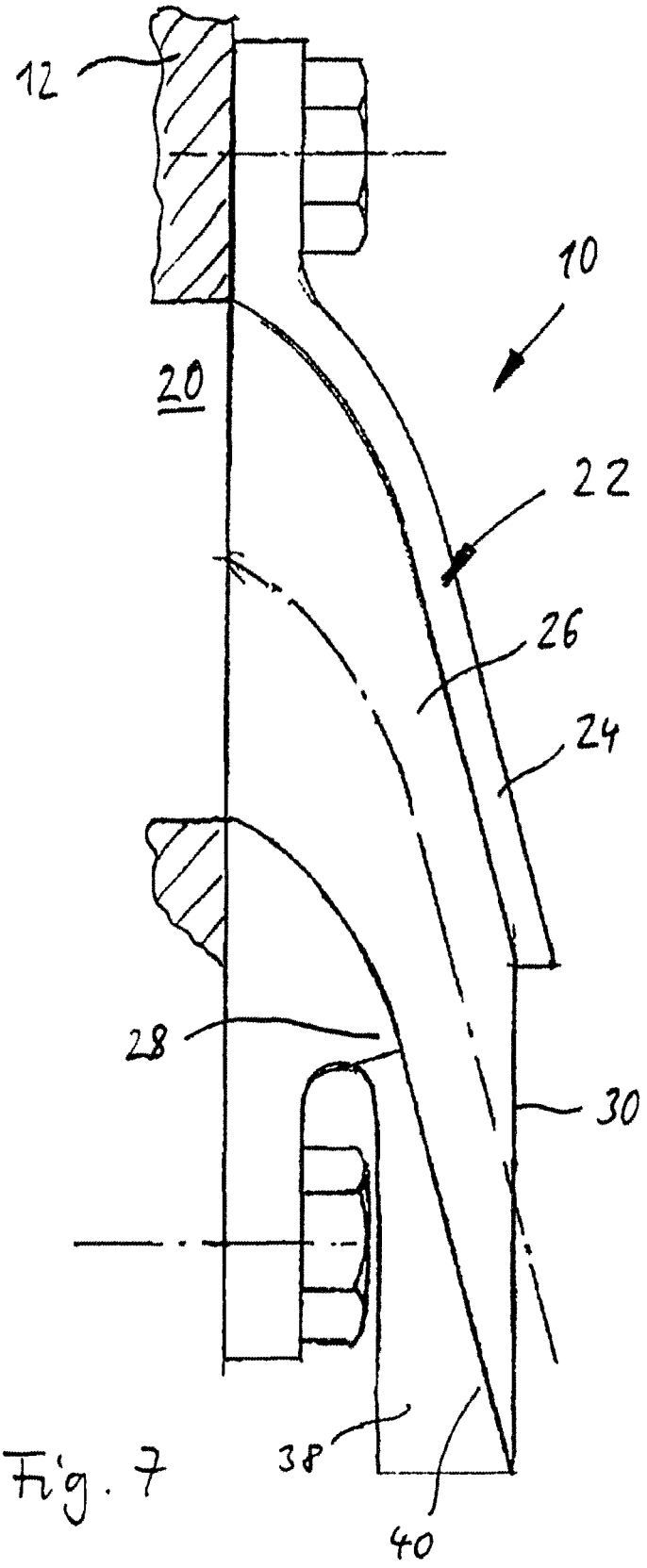

In FIG. 7, one embodiment of the outlet device 10 is depicted, wherein a flow guiding surface 38 is formed at the end of the channel of the diverting channel 22. To this end, the side wall 28 of the diverting channel 22 pointing toward the end wall 12 is shortened, and the weir edge 30 is designed to have a second weir edge portion 40 pointing toward the end wall 12. As viewed in the top view, the weir edge 30 thus forms a tip pointing in the flow direction of the material flowing off (see FIG. 7 at the bottom).

Figure 8:
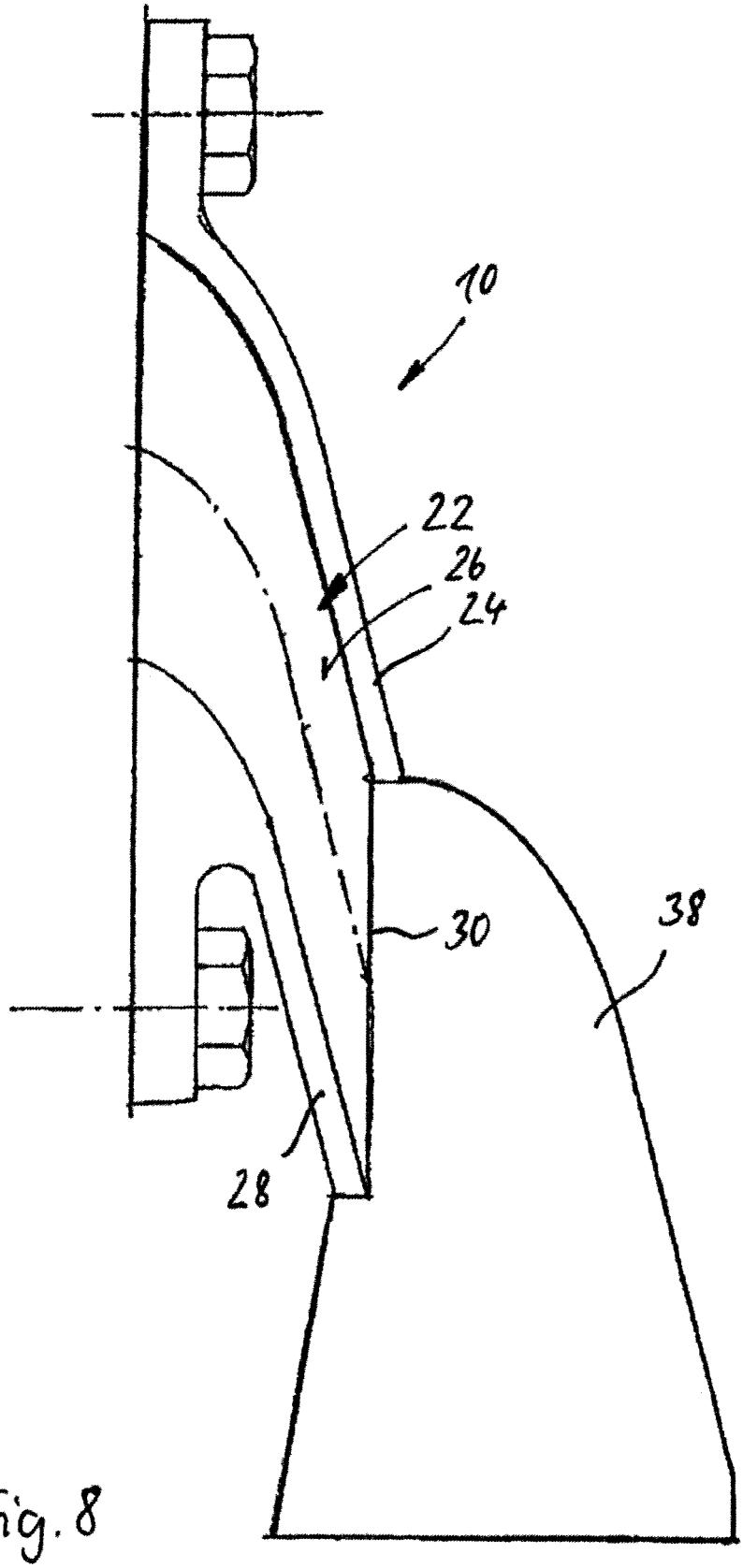

FIG. 8 shows an outlet device 10, in which the side walls 24 and 28 are designed like in the example shown in FIG. 6. At the same time, a flow guiding surface 38 is positioned in the flow direction behind the weir edge 30. This flow guiding surface 38 is designed as a mostly planar surface without side edges or side walls and so as to expand in a funnel-shape in the flow direction.

Figure 9:
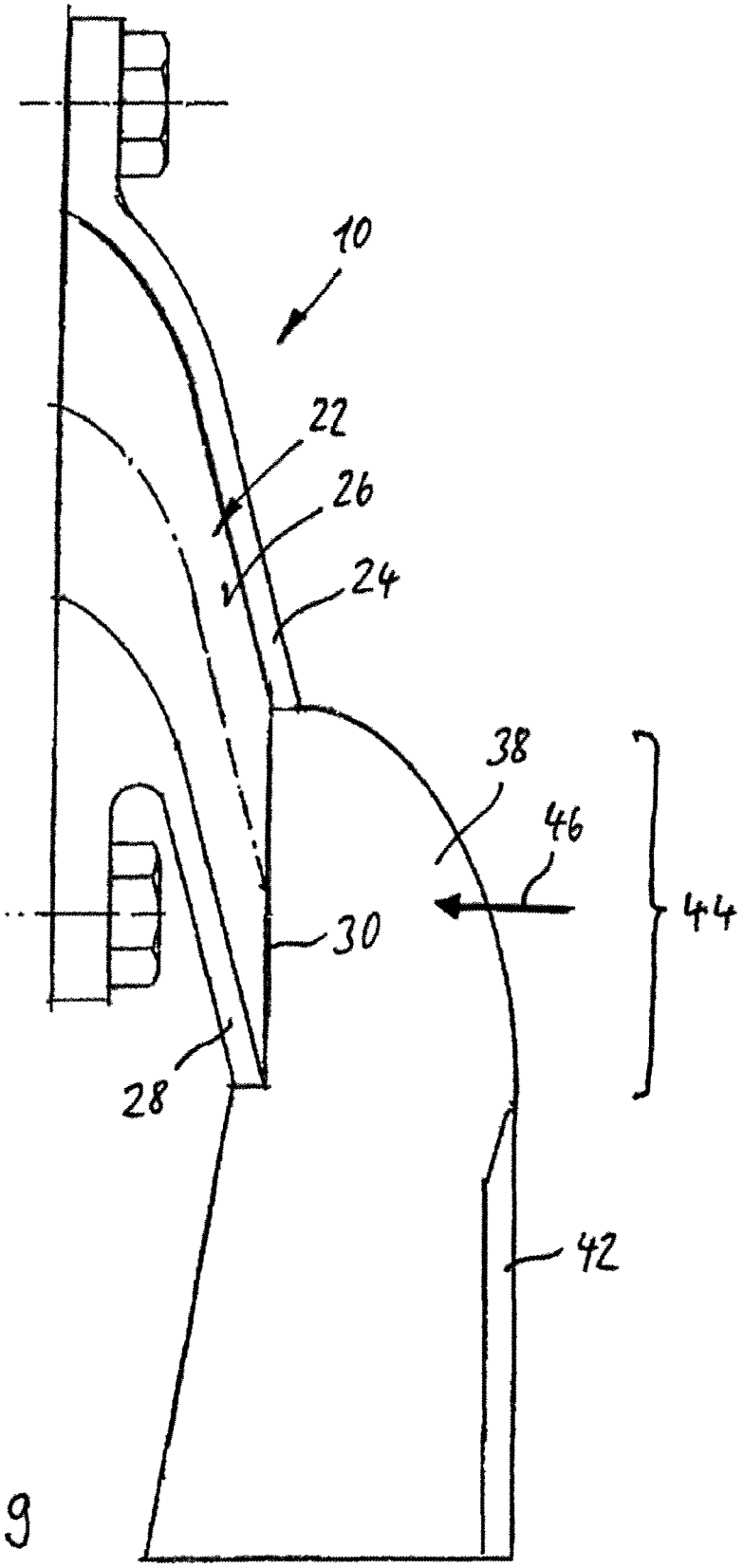

FIG. 9 depicts one exemplary embodiment of an outlet device 10, in which such a flow guiding surface 38 as shown in FIG. 8 is provided in addition, on its side facing away from the end wall 12, with an end wall 42. The side wall 42 extends in this case only over the rear part of the flow guiding surface 38 in the flow direction, whereas an area or portion 44 of the projection of the weir edge 30 in the axial direction 46 is designed without a side wall. This free area on the flow guiding surface allows as little air resistance as possible to develop there during the rotation of the centrifuge drum because of the minimum projection surface.

Figure 10:
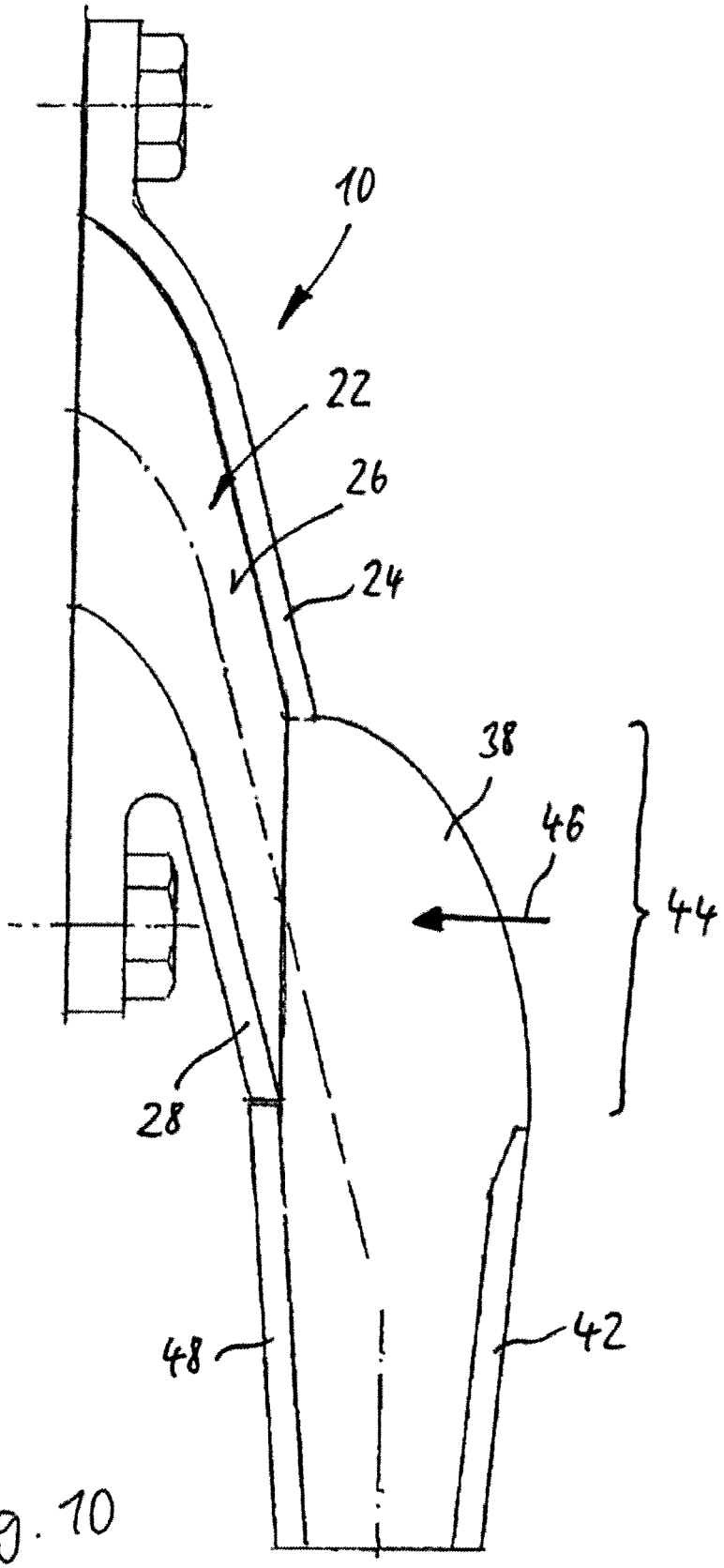
Figure 11:
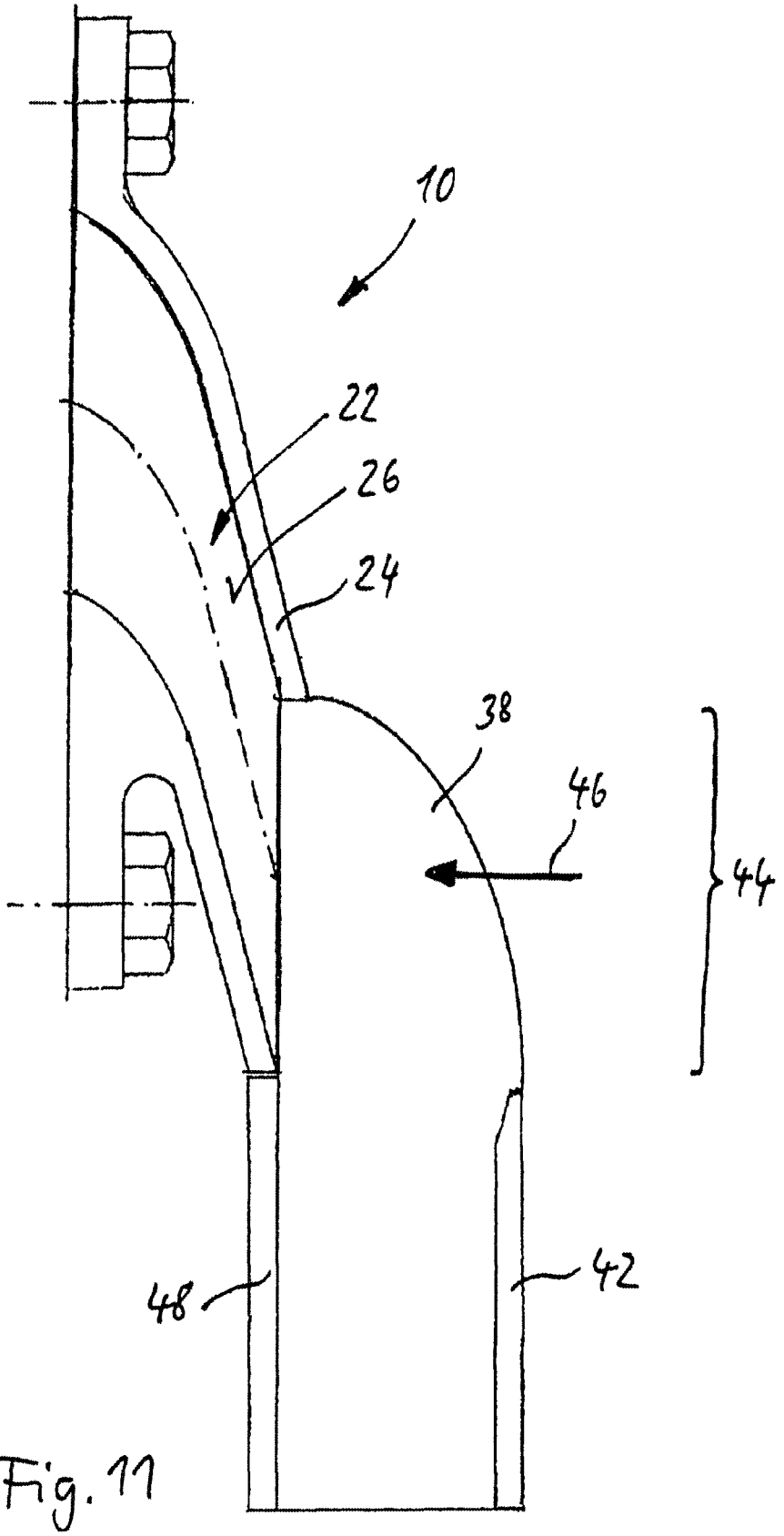

In FIGS. 10 and 11, two further embodiments of an outlet device 10 are depicted, in which the flow guiding surface 38 is provided with a second side wall 48 also on its side facing the end wall 12. In this case, the side walls 42 and 48 according to FIG. 10 are designed such as to form a channel tapering in the flow direction, whereas the side walls 42 and 48 according to FIG. 11 extend in parallel to one another.

Figure 12:
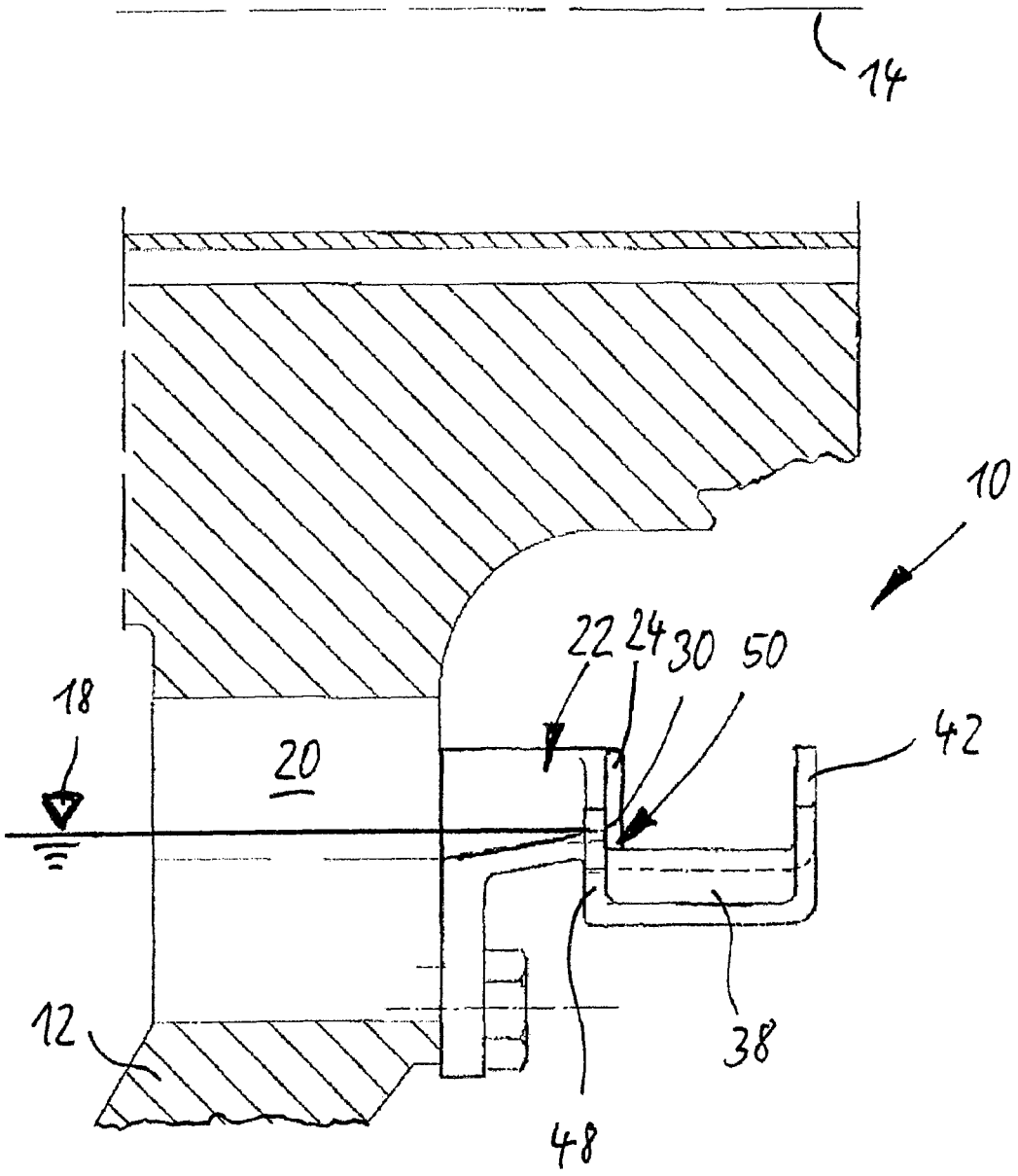

FIG. 12 finally depicts that the respective flow guiding surfaces 38 are always radially slightly further outside directly behind the associated weir edges 30 so that a small step 50 is developed directly behind the weir edge 30.

Finally, it should be noted that all of the features mentioned in the application documents and in particular in the dependent claims should be provided, even individually or in any combination, with individual protection, despite of the formal back reference made to one or more particular claims.

LIST OF REFERENCE NUMERALS

10 outlet device
12 end wall of a centrifuge drum of a solid-bowl screw centrifuge
14 longitudinal axis
16 rotational direction
18 pool radius or liquid level
20 outlet opening
22 diverting channel
24 side wall of the diverting channel
26 bottom surface of the diverting channel
28 side wall of the diverting channel
30 weir edge
32 angle of the diversion of the flow of the liquid phase
34 angle of the orientation of the weir edge
36 flow guiding element
38 flow guiding surface
40 second weir edge portion
42 side wall of the flow guiding surface
44 portion without side wall
46 axial direction
48 side wall of the flow guiding surface
50 step

The invention claimed is:

1. An outlet device (10) of a solid-bowl screw centrifuge for separating a multi-phase material, which outlet device is arranged on an end wall (12) of a centrifuge drum, which rotates about a longitudinal axis (14), at an outlet opening (20) formed in the end wall (12), which outlet device comprises a diverting channel (22) for diverting a liquid phase of the material which passes through the outlet opening (20), wherein the diversion relative to the longitudinal axis (14) amounts to an angle between 50° and 90° with respect to the circumferential direction, and which has an aligned rectilinear weir edge (30) for limiting the emergence of the liquid phase, wherein the angle of the alignment of the weir edge (30) relative to the end wall (12) as viewed from the outlet opening (20) is less than 0° to minus 6° toward the end wall (12), wherein the weir edge (30) is at the end of the diverting channel (22).

2. The outlet device according to claim 1, wherein the diverting channel (22) is designed as a radially inward open channel.

3. The outlet device according to claim 1, wherein the diverting channel (22) is designed to be narrowing in the flow direction of the liquid phase.

4. The outlet device according to claim 1, wherein at least one flow guiding element (36) is arranged in the diverting channel (22).

5. The outlet device according to claim 1, wherein in the flow direction of the liquid phase behind the weir edge (30), a flow guiding surface (38), over which exiting liquid phase flows, is provided, and which, as viewed in the axial direction (46) is designed without a side wall at least in sections on one side.

6. The outlet device according to claim 5, wherein the flow guiding surface (38) has a main flow direction which is oriented to be pivoted above the weir edge (30) toward the end wall (12) as compared to a main flow direction of the liquid phase.

7. The outlet device according to claim 5, wherein the flow guiding surface (38) is spaced from the end wall (12) on the side of the drum.

8. The outlet device according to claim 1, wherein the diverting channel (22) is mounted to the end wall (12) of the centrifuge drum so as to be adjustable.

9. A solid-bowl screw centrifuge for separating a multi-phase material by means of a centrifuge drum which has at least one outlet device (10) according to claim 1.

10. An outlet device (10) of a solid-bowl screw centrifuge for separating a multi-phase material, which outlet device is arranged on an end wall (12) of a centrifuge drum, which rotates about a longitudinal axis (14), at an outlet opening (20) formed in the end wall (12), which outlet device comprises a diverting channel (22) for diverting a liquid phase of the material which passes through the outlet opening (20), wherein the diversion relative to the longitudinal axis (14) amounts to an angle between 50° and 90° with respect to the circumferential direction, and which has an aligned rectilinear weir edge (30) for limiting the emergence of the liquid phase, wherein the angle of the alignment of the weir edge (30) relative to the end wall (12) as viewed from the outlet opening (20) amounts to between 0° relative to the end wall (12) and minus 6° toward the end wall (12), wherein in the flow direction of the liquid phase behind the weir edge (30), a flow guiding surface (38), over which exiting liquid phase flows, is provided, and which, as viewed in the axial direction (46) is designed without a side wall at least in sections on one side.

11. An outlet device (10) of a solid-bowl screw centrifuge for separating a multi-phase material, which outlet device is arranged on an end wall (12) of a centrifuge drum, which rotates about a longitudinal axis (14), at an outlet opening (20) formed in the end wall (12), which outlet device comprises a diverting channel (22) for diverting a liquid phase of the material which passes through the outlet opening (20), wherein the diversion relative to the longitudinal axis (14) amounts to an angle between 50° and 90° with respect to the circumferential direction, and which has an aligned rectilinear weir edge (30) for limiting the emergence of the liquid phase, wherein the angle of the alignment of the weir edge (30) relative to the end wall (12) as viewed from the outlet opening (20) amounts to between 0° relative to the end wall (12) and minus 6° toward the end wall (12), wherein in the flow direction of the liquid phase behind the weir edge (30), a flow guiding surface (38), over which exiting liquid phase flows, is provided, wherein the flow guiding surface (38) has a main flow direction which is oriented to be pivoted above the weir edge (30) toward the end wall (12) as compared to a main flow direction of the liquid phase.

12. An outlet device (10) of a solid-bowl screw centrifuge for separating a multi-phase material, which outlet device is arranged on an end wall (12) of a centrifuge drum, which rotates about a longitudinal axis (14), at an outlet opening (20) formed in the end wall (12), which outlet device comprises a diverting channel (22) for diverting a liquid phase of the material which passes through the outlet opening (20), wherein the diversion relative to the longitudinal axis (14) amounts to an angle between 50° and 90° with respect to the circumferential direction, and which has an aligned rectilinear weir edge (30) for limiting the emergence of the liquid phase, wherein the angle of the alignment of the weir edge (30) relative to the end wall (12) as viewed from the outlet opening (20) amounts to between 0° relative to the end wall (12) and minus 6° toward the end wall (12), wherein in the flow direction of the liquid phase behind the weir edge (30), a flow guiding surface (38), over which exiting liquid phase flows, is provided, wherein the flow guiding surface (38) is spaced from the end wall (12) on the side of the drum.

* * * * *